United States Patent [19]

Lambert, Jr.

[11] 4,195,834

[45] Apr. 1, 1980

[54] VERTICAL SHOULDER AND LATERAL SHOULDER EXERCISE MACHINE

[76] Inventor: Lloyd J. Lambert, Jr., 1538 College Ave., South Houston, Tex. 77587

[21] Appl. No.: 923,818

[22] Filed: Jul. 12, 1978

[51] Int. Cl.[2] ..... A63B 23/02

[52] U.S. Cl. ..... 272/118; 248/125

[58] Field of Search ..... 297/338; 182/135; 272/117, 118; 403/43; 248/125, 295 B

[56] References Cited

U.S. PATENT DOCUMENTS

| | | | |
|---|---|---|---|
| 1,307,468 | 6/1919 | Wells | 182/135 |
| 2,675,132 | 4/1954 | Susil | 148/125 X |
| 3,912,261 | 10/1975 | Lambert | 272/118 |
| 3,998,454 | 12/1976 | Jones | 272/117 |

OTHER PUBLICATIONS

"Time Machines" by Nautilus, insert to Iron Man; 7/1973, pp. 1, 58, 59 and 68.

*Primary Examiner*—Richard J. Johnson

*Attorney, Agent, or Firm*—Victor J. Evans & Co.

[57] ABSTRACT

Disclosed herein is a machine for exercising various parts of the body and muscles. In one form of the invention there is provided a vertical shoulder exercising machine wherein bars are pushed up on to exercise vertical shoulder muscles and the like. The lateral shoulder exercising machine has hand grips adapted to be manually expanded to actuate a cam mechanism which is operatively connected to weights so that the user can perform the desired exercises.

5 Claims, 5 Drawing Figures

VERTICAL SHOULDER AND LATERAL SHOULDER EXERCISE MACHINE

BACKGROUND OF THE INVENTION

Various types of exercising equipment have heretofore been provided that have had various disadvantages which are overcome by means of the present invention.

Patents of which the inventor is aware of include U.S. Pat. Nos. 3,635,472, 3,708,166, 3,734,495, 3,746,338, 3,770,267, 3,858,873 and 3,912,261.

None of these reference anticipate the following specification and claims in that they are lacking in disclosing applicant's claimed structure and concepts.

SUMMARY OF THE INVENTION

Accordingly the present invention eliminates the danger of having weights accidentally injuring a user;in addition the parts are arranged and constructed so that the most efficient utilization thereof can be accomplished.

OBJECTS OF THE INVENTION

Accordingly it is an object of the present invention to provide health equipment in the form of exercising machines that can be used for exercising vertical shoulder and lateral shoulders, and wherein the parts can be adjusted to provide a means for varying the effect to be provided.

Still another object of the present invention is to provide vertical shoulder and lateral shoulder exercising machines that have improved characteristics and advantages as compared to previous machines.

Still another object of the present invention is to provide vertical shoulder and lateral shoulder exercising machines that are generally rugged in construction and efficient in use.

Other objects and advantages will become apparent when considering the following specification and claims when considered in light of the attached drawings.

DESCRIPTION OF THE PREFERRED EMBODIMENT

Figure 1:
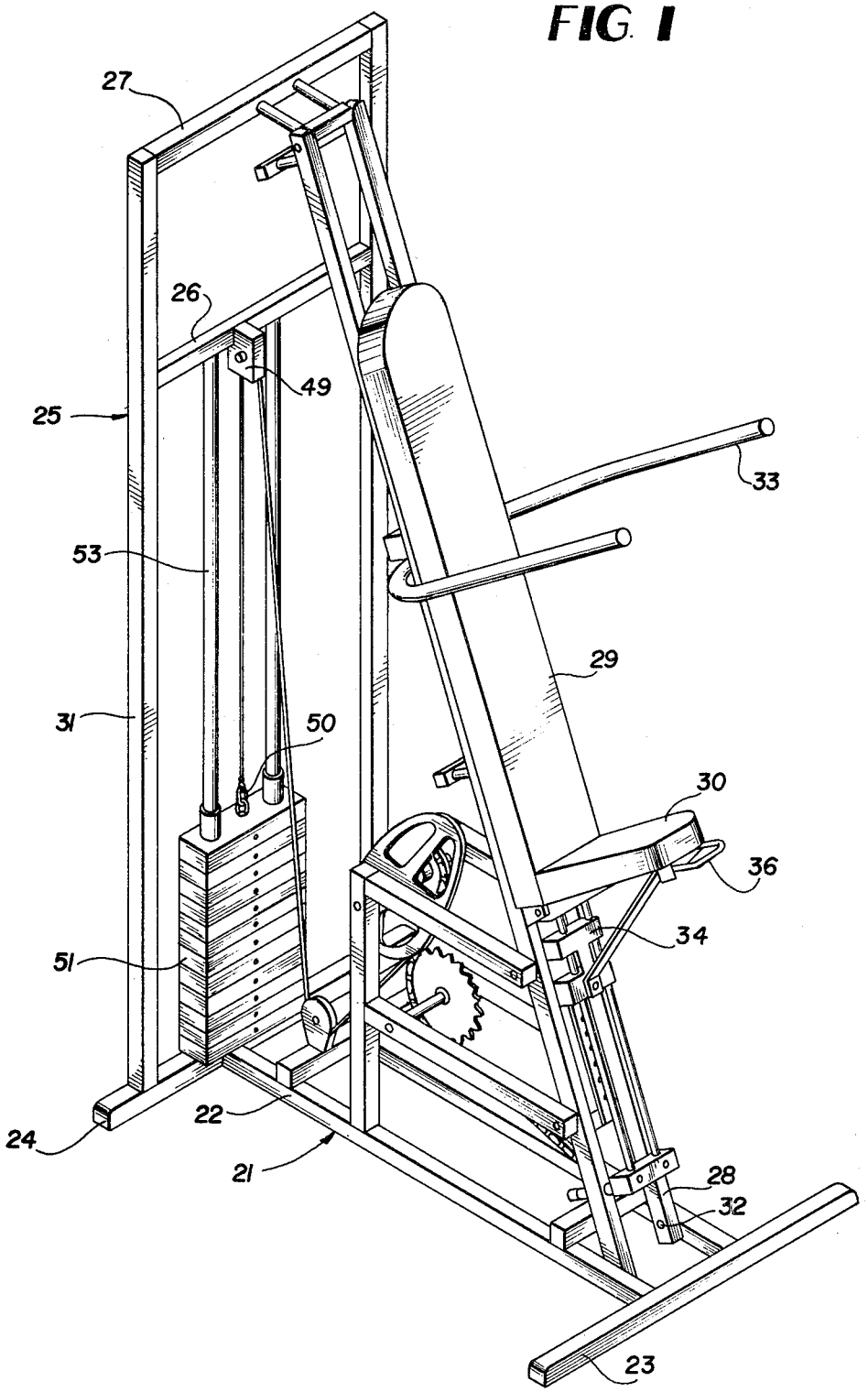
FIG. 1 is a perspective view of a vertical shoulder exercising machine.
Figure 1A:
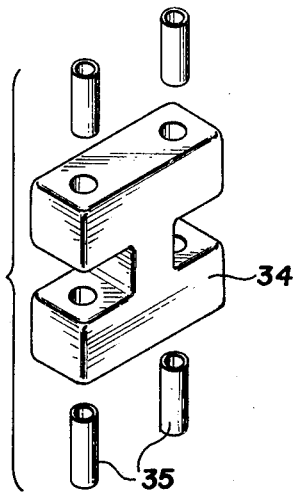
FIG. 1*a* shows the bearing details of element 34, FIG. 1.

Referring in detail to the drawings, and more particularly to FIG. 1 of the drawings, there is shown a vertical shoulder exercising machine. The numeral 20 indicates a vertical shoulder exercising machine that includes a horizontally disposed base 21. The base 21 includes spaced parallel horizontally disposed bars 22 that have cross piece 23, 24 secured to the ends thereof. A vertically disposed frame 25 is mounted on the cross piece 24, and the frame 25 includes vertically disposed spaced parallel bars 31 that have cross pieces 26 and 27 extending therebetween and being secured thereto.

Inclined support pieces 28 have their lower ends connected as at 32 to the members 22, and the support pieces 28 have an inclined bench 29 suitably affixed thereto. An adjustable seat 30 is provided for supporting the user, and the seat 30 is arranged contiguous to the bench 29.

A handle bar or hand grip assembly 33 is adapted to be manually pushed up on when using the exercising machine with a person seated on the seat 30, and the hand grip 33 is connected to an H-frame 34. The H-frame 34 has bushings 35 associated therewith. A supporting assembly 36 is provided for the seat 30.

A chain 37 is connected as at 52 to the H-frame 34, and the chain 37 is arranged in engagement with an idler sprocket 38. The chain 37 is further arranged in engagement with teeth on the outer periphery of a sprocket 39, and an end of the chain 37 is anchored as at 40 to the sprocket 39. Operatively connected to the sprocket 39 is a smaller sprocket 41, and a chain 42 has an end thereof connected to the sprocket 41 as at 43. The chain 42 is arranged in engagement with a small sprocket 45, and an end of the chain 42 is anchored to the sprocket 45 as at 44. The sprocket 45 is operatively connected to a cam 46. A cable 47 has one end secured to the cam 46, and the cable 47 engages a pulley 48, and the cable 47 also engages an upper pulley 49, and an end of the cable 47 is secured to weights 51 as at 50., FIG. 3.

The weights 51 have an operation and construction generally similar to that shown and described in prior pending application serial No. 893,615 filed Apr. 5, 1978. These weights 51 can move on vertically disposed rods 53.

There is provided for the seat support 36 a handle 54, and the numeral 55 indicates a pin that engages an opening 56, the pin 55 having a spring 57 circumposed thereon for maintaining the parts under the proper pressure. The numeral 58 indicates a reset locking mechanism, and a H-frame 60 includes ball bushings 59 for linear motion on members 61. A rubber stop 62 is provided for preventing the handle bar 33 that is being pushed up on from falling on the users shoulders. As shown on the drawings the back seat 29 is adapted to be arranged at an angle, and the adjustable seat 30 is operatively connected thereto, FIGS. 4, 3 and 1, respectively.

From the foregoing, it will be seen that there has been provided a vertical shoulder exercising machine, and in use with the parts arranged as shown in the drawings, the user is seated on the seat 30 with his back against the bench 29 of the machine 20. Attached to the back of the bench 29 is a track along which the H-frame 34 slides. The hand grips 33 are attached to the H-frame 34. The chain 37 is attached to the bottom of the H-frame 34, and this chain 37 engages an idler sprocket 38 as well as a sprocket 39, and an end of the chain 37 is secured as at 40 to the sprocket 30. The sprocket 39 has a smaller sprocket 41 operatively connected thereto so that the sprockets 39 and 41 rotate in unison. The sprocket 41 has a chain 42 anchored as at 43 thereto, and the chain 43 engages a sprocket 45, and the sprocket 45 has an end of the chain 42 anchored thereto as at 44. The sprocket 45 is operatively connected to the cam 46. Thus, as the operator pushes up on the bars 33, due to the provision of the chains and sprockets, the cam 46 will be rotated or moved. The cam 46 has the cable 47 connected thereto so that this movement of the cam 46 will cause the cable 47 to be moved, the cable 47 being arranged in engagement with pulleys 48 and 49. The cable 47 is connected to the weights 51 so that these weights will be pulled.

The previously described sprockets are suitably supported by sleeves and the like through which extend pins, shafts and other suitable members. Similarly the cam is supported by a sleeve and pin arrangement.

The bench 29 is secured at its top to the frame and the bottom seat 30 is adjustable.

The adjustable mechanism for the seat 30 is adjusted by the handle 54 and can be manually actuated to move the pin 55, as shown in the drawings.

The parts can be made of any suitable material and in different shapes and sizes as desired or required.

Figure 5:
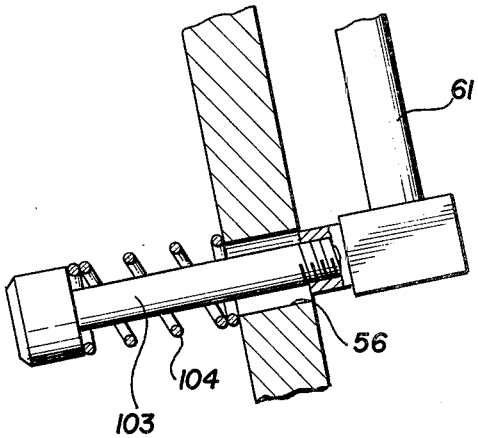
FIG. 5 shows the spring arrangement for the seat adjustment of FIG. 2.
Figure 2:
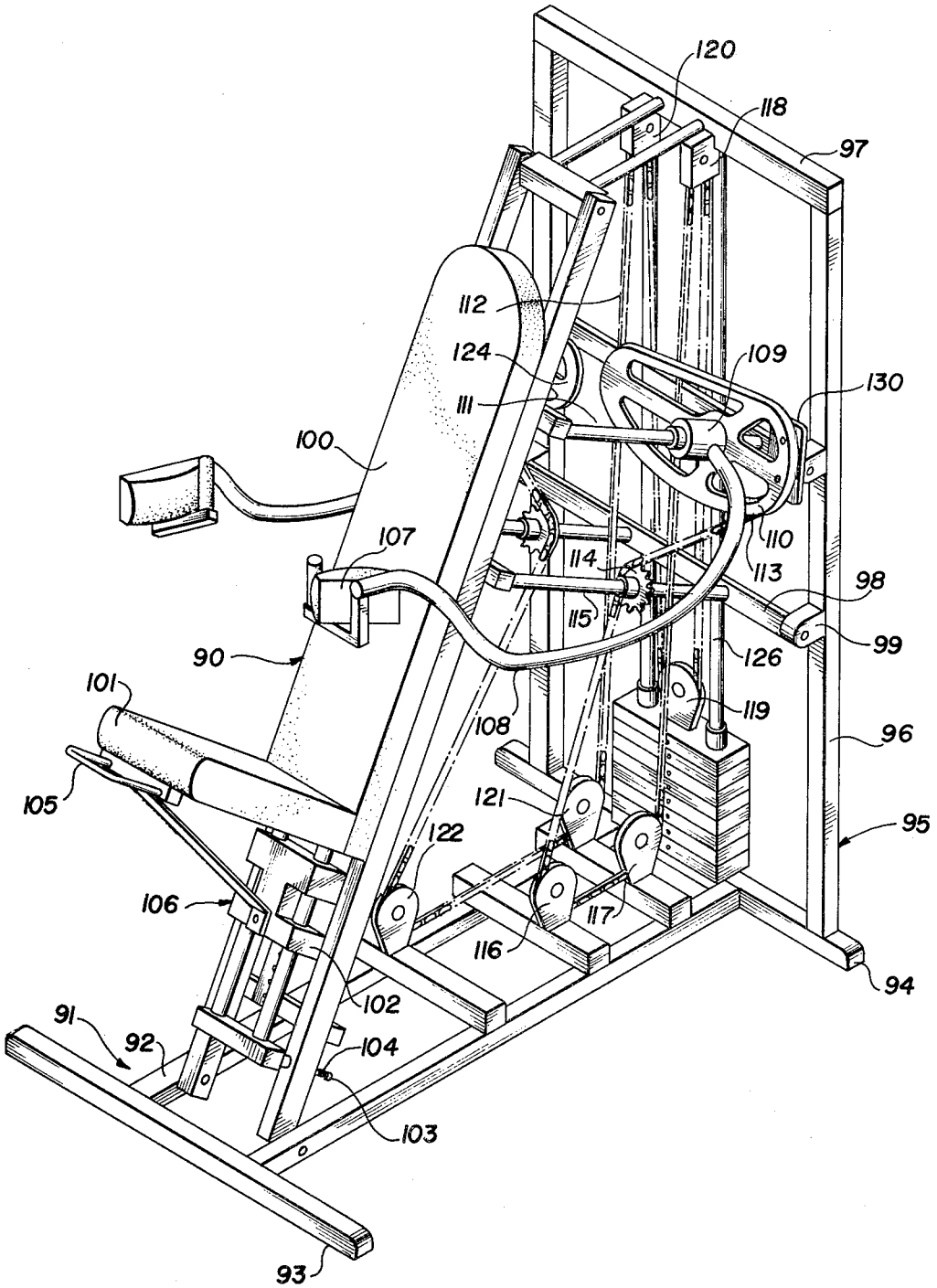
FIG. 2 is a perspective view of a lateral shoulder exercising machine.

Referring now to FIG. 2 of the drawings the numeral 90 indicates a lateral shoulder exercising machine that includes a horizontally disposed base 91 that is provided with spaced parallel bars 92 as well as end pieces 93 and 94. There is further provided for the lateral shoulder exercising machine 90 a vertically disposed frame 95 that includes upstanding posts or bars 96 that have a top piece 97 connected thereto. A cross piece 98 is connected to the members 96 as at 99. The numeral 100 indicates an incline bench or back rest which has a seat 101 associated therewith, and an adjusting means 106 is provided for the seat 101. A handle 105 can be actuated to adjust the seat 101, and a H-frame 102 is provided for the seat adjusting mechanism 106. The mechanism 106 further includes a pin 103 that has a coil spring 104 thereon, FIG. 5.

With further reference to the lateral shoulder exercising machine 90, handles 107 are secured to ends of arms 108 so that as the handles 107 are pushed sideways, the arms 108 will rotate cam bushings 109. The cam bushings 109 are supported by pin sleeve elements 111, and the cams are indicated by the numeral 110. A chain 112 is provided, and an end of the chain 112 is secured to a cam 110 as at 113. The chain 112 engages a sprocket 114, and the sprocket 114 is supported by a rod or sleeve 115 which is connected to the back bench 100. The rod 115 is also connected to the cross 98. The direction of the chain 112 is further changed on the base sprocket. The chain 112 engages base sprockets 116 and 117 as well as the head sprocket 118 and main sprocket 119, and the chain 112 also engages another head sprocket 120 as well as further base sprockets 121 and 122, and an end of the chain 112 is connected to the other cam 124 as at 123.

From the foregoing and with further reference to the lateral shoulder exercising machine 90, the machine will be seen as having a generally inclined bench 100 which has a substantially greater length than width and which is supported at its extremities by suitable supports. A pair of cams 110 and 124 are positioned as shown, and the cams are provided with grooves on their outer periphery and these grooves serve as guides for the chain 112. Exercise is accomplished by a person sitting on the seat 101 and grasping the handles 107 with the palms inward so that by pushing the handles 107 horizontally outwardly, the arms 108 will move the cam bushings 109 in such a way as to rotate the cams 110 and 124 so as to cause the attached chain 112 to be wound around the periphery of the cams. The chain 112 follows a course prescribed by the sprockets that the chain engages so that the chain is thereby caused to lift the weights 125. The weights 125 are supported on two parallel bar members 126 which are firmly attached above and below to the frame. The bars 126 extend through suitable openings in the weights 125. When raised by the chain, the weights 125 follow the vertical course prescribed by the parallel bars 126.

Block elements 130 are disposed two each to the pair of D-shaped cams 110 and they function as counterbalance weights. Blocks 130 tend to make the cams 115 more massive, increase the inertia on starting the exercise, and provide the counterbalance necessary to react against the weights 125 should they be released suddenly. The cams 110 are configured such that mechanical advantage is lost as the exercise progresses beyond the initialized state. Since the radius (moment arm) of the cam decreases during the exercise (defined by the last chain link touching the cam and its distance to the center of the cam shaft), the work done on the machine when the arms are closest to the body is least. As the arms move outwardly the effective weight moved increases as the mechanical advantage of the arms moving away from the body decreases. Therefore effective work against the machine can be performed throughout the cycle with the optimum weight.

Figure 3:
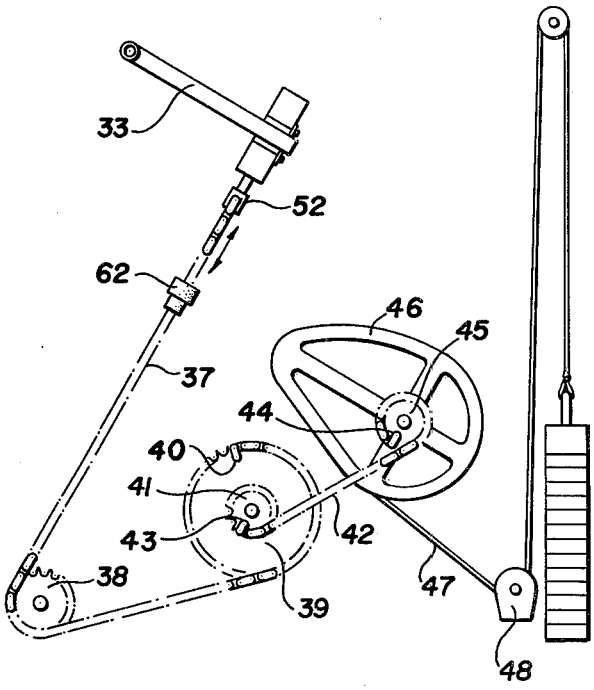
FIG. 3 shows the gearing of FIG. 1 and the associated cable system, opposite from the perspective shown.
Figure 4:
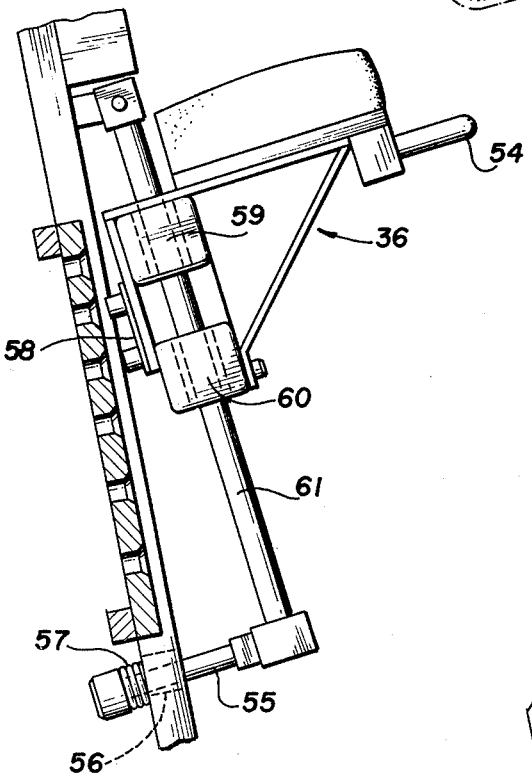
FIG. 4 shows the seat construction detail.

The cam effect in the vertical machine of FIG. 1 is somewhat different since the radius (between the cable and the cam shaft) remains substantially constant initially and thereafter decreases along the top of the cam surface (FIG. 3). The moment arm (radius of the cam at that point) decreasing causes the work done to increase in difficulty at the extreme stroke of the exercise thereby reducing the advantages obtained from momentum, etc. Lighter weights can therefore be used.

The construction and function of the weights 125 is generally similar to that described in connection with the weights 51.

Having thus described the preferred embodiment of the invention it should be understood that numerous structural modifications and adaptations may be resorted to without departing from the spirit of the invention.

What is claimed is:

1. In an exercising machine, a horizontally disposed base, an upright frame supported on said base, an incline bench operatively connected to said base, a seat adjustably connected to said bench, manually operable means for adjusting said seat defined by spaced parallel rod members (61) pivotally connected at a top extremity to inclined support pieces (28) and at a bottom extremity to said inclined support pieces through a biased pin(55) extending through an opening on said inclined support pieces so that said rod members are naturally drawn to said inclined support pieces, an H-shaped frame member (60) slideably disposed on said rod members having a reset locking mechanism on a back face thereof and a seat support on a top face provided with a handle whereby pulling on said handle tensions said biased pin and unlatches said reset locking mechanism so that said H frame can slide on said rod members adjusting said seat, and when said handle is released said biased pin causes said reset locking mechanism to be latched, weight means for said machine, cam means on said machine, chain and sprocket means operatively connected to said cam means, and manually engageable gripping means for actuating said cam means and said weight means.

2. The structure as defined in claim 1 wherein said cam means includes a cam having an eccentric shape, and said manually engageable gripping includes a hand grip to be selectively pushed upwardly by a person seated on the seat.

3. The structure as defined in claim 2 wherein the machine is a vertical shoulder exercising machine.

4. The structure as defined in claim 1 wherein the cam means includes a pair of cams, arms operatively connected to said cams, hand grips affixed to said arms, and chain and sprocket means operatively connecting said cams to said weight means.

5. The structure as defined in claim 4 wherein the machine is a lateral shoulder exercise machine.

* * * * *